US005177830A

United States Patent [19]

Montabaur et al.

[11] Patent Number: 5,177,830

[45] Date of Patent: Jan. 12, 1993

[54] ROTATIVELY DRIVEABLE TOOL CHUCKING DEVICE

[75] Inventors: Werner Montabaur, Königswinter; Detlef Thomas, Cologne, both of Fed. Rep. of Germany

[73] Assignee: Monti-Werzeuge GmbH, Steinbruchweg, Fed. Rep. of Germany

[21] Appl. No.: 281,802

[22] Filed: Dec. 8, 1988

[30] Foreign Application Priority Data

Dec. 11, 1987 [DE] Fed. Rep. of Germany ..... 3741983

[51] Int. Cl.[5] ..... A46B 7/10

[52] U.S. Cl. ..... 15/179; 51/168

[58] Field of Search ..... 15/179, 181; 51/168, 51/334; 409/231, 232, 233, 234

[56] References Cited

U.S. PATENT DOCUMENTS

| | | | |
|---|---|---|---|
| 680,418 | 8/1901 | Ross | 15/179 |
| 1,281,777 | 10/1918 | Hardy | 15/179 |
| 1,329,857 | 2/1920 | Rosner | 51/168 |
| 1,990,025 | 2/1935 | Frost | 15/181 |
| 2,002,370 | 5/1935 | Frost | 15/181 |
| 2,187,350 | 1/1940 | Kuzmick | 51/168 |
| 2,403,813 | 7/1946 | Manderscheid | 51/168 |
| 2,756,452 | 7/1956 | Nielsen | 15/179 |
| 2,922,262 | 1/1960 | Atkins | 51/168 X |
| 3,481,017 | 12/1969 | Hunt . | |
| 3,561,173 | 2/1971 | Block | 51/334 |
| 4,177,611 | 12/1979 | Carr-Rollett | 51/389 X |
| 4,209,873 | 7/1980 | Schaefer | 15/182 |
| 4,258,509 | 3/1981 | Wray et al. | 51/334 |
| 4,365,448 | 12/1982 | Wilson | 51/334 |
| 4,455,788 | 6/1984 | Freerks | 51/334 |
| 4,627,127 | 12/1986 | Dupre | 15/179 |

FOREIGN PATENT DOCUMENTS

| | | | |
|---|---|---|---|
| 1514848 | 6/1978 | United Kingdom | 51/334 |

*Primary Examiner*—Philip R. Coe
*Assistant Examiner*—Mark Spisich
*Attorney, Agent, or Firm*—Anderson Kill Olick & Oshinsky

[57] ABSTRACT

A rotatively driveable tool chucking device with at least two chucking disks and a common tightening screw for chucking a tool sleeve between the two chucking disks. The chucking disks have concentric annular grooves for chucking tool sleeves with essentially the same diameter. When the sleeves are of flexible material, they are rotationally stabilized about the central axis of rotation, without requiring a rubber core or similar support body. This stabilization maintains the sleeves always in cylindrical shape.

6 Claims, 3 Drawing Sheets

ROTATIVELY DRIVEABLE TOOL CHUCKING DEVICE

BACKGROUND OF THE INVENTION

1. Field of the Invention

The present invention relates to a rotatively driveable tool chucking device having at least two chucking disks and a common tightening screw for chucking a tool sleeve between the two chucking disks. Within the scope of the present invention, a tool sleeve is a sleeve-like tool, i.e., a sleeve having an outer surface which forms a tool. The tool may be, for example, a grinding sleeve of abrasive paper, a brush sleeve with radially projecting bristles or the like.

2. Description of the Related Art

In tool chucking devices of the above-described type, it is frequently difficult to chuck particularly bendable tool sleeves, i.e., tool sleeves of bending-elastic or flexible material, i.e., material which is not sufficiently bending resistant. This is not only true with respect to problem-free positioning or centering between the chucking disks, but also with respect to a sufficient stabilization in order to be able to absorb without deformation the loads acting on the tool sleeve during use.

For these reasons, rubber cores are usually used which are inserted into the tool sleeves and are chucked between the chucking disks together with the tool sleeves. When the sleeve material expands after long use, the rubber cores of this type are pressed in further in order to obtain at all times a sufficient support of the tool sleeves on the rubber cores. However, this further compression of the rubber cores poses problems because the rubber cores cause a bulging of the tool sleeves, so that the contact surface available for the various work processes becomes continuously smaller. Moreover, the smaller contact surface is subjected to increased wear. The small contact surface of the tool results in an uneconomical use of the tool and the increased wear makes the process expensive. Another problem is the fact that rubber cores must have a particularly high restoring capability in order to be able to receive new tool sleeves without problems.

It is, therefore, the primary object of the present invention to provide a rotatively driveable tool chucking device in which the above-described disadvantages are avoided. In particular, a tool chucking device of the above-described type is to be provided which does not use a rubber core or similar support bodies and always ensures a problem-free positioning and stabilization of the tool sleeve chucked in the device, so that the loads acting on the sleeve during use do not result in deformations, i.e., that always a cylindrical tool surface is available, even if the tool sleeve is of a flexible material.

SUMMARY OF THE INVENTION

In accordance with the present invention, the two chucking disks have concentric annular grooves for chucking tool sleeves having essentially the same diameter.

As a consequence of these measures of the invention, the tool sleeves of flexible material surprisingly obtain a rotational stability which increases with increasing rate of rotation about the central axis of rotation of the sleeve. As a result, a bending-resistant tool cylinder is built up which is capable of absorbing highest loads acting on it with restoring effects, without any deformations during use. This rotational stability is apparently due to the generated centrifugal forces. This rotational stability moreover ensures a correct centering of the respective tool sleeves in the annular grooves. At any rate, the tool chucking device according to the present invention renders superfluous the use of conventional rubber cores or similar support members for tool sleeves, even those of flexible or bendable material.

In accordance with an important feature of the present invention, one of the chucking disks has axial webs which extend on the outside over the chucked tool sleeve and the other chucking disk has recesses for insertion of the ends of the axial webs, wherein the axial webs and the recesses are circumferentially equally spaced, by 120°. The axial webs ensure that the cylindrical shape of the tool sleeve is maintained even when extremely high centrifugal forces occur.

The tool sleeves may have longitudinal grooves for receiving the axial webs in a hidden manner. However, the axial webs may also extend on the outer surface of the sleeve between the tool elements cantilevering over them.

The axial webs preferably extend along the outer circumference of the corresponding annular groove, so that the axial webs do not project beyond the outer circumference of the chucking disks. Adjacent the inner circumference of each annular groove is arranged a centering cone which facilitates the centering and positioning of the tool sleeves.

In accordance with another proposal of the present invention, the two chucking disks are spaced apart when the tool sleeve is chucked by means of a central shaft which has a central bore for passing the tightening screw therethrough, wherein one of the chucking disks has the central shaft with a polygonal receiving recess at the end and the other chucking disk has a corresponding insertion bolt. The polygonal insertion opening and the polygonal insertion bolt are adjusted in such a way to the circumferential distribution of the axial webs that the two chucking disks can be quickly and easily connected with the intermediate arrangement of the respective tool sleeve and can be tightened by means of the tightening screw. The axial web as well as the central shaft ensure that the two chucking disks are always correctly spaced apart, i.e., a deformation of flexible tool sleeves is prevented already when the tool sleeve is mounted between the chucking disks. Moreover, the axial webs and the central shaft provide a connection between the chucking disks such that the chucking disks cannot be rotated relative to each other. The axis of rotation always extends through the chucking disks and the center shaft and the tightening screw.

In accordance with another recommended feature of the present invention, the tightening screw has a tightening nut constructed as an adapter which can be inserted, on the one hand, in an outer insertion recess of the respective chucking disks so as to be non-rotatable therein, and, on the other hand, is equipped for connecting a drive, for example, of a drilling machine or of an angle grinding machine. This usually polygonally constructed adapter can be easily inserted, for example, in the chucking head of a drilling machine or an angle grinding machine and has a threaded bore into which the end of the tightening screw is screwed. At the same time, the adapter is non-rotatably seated in the insertion recess of the corresponding chucking disk.

Under certain operating conditions, for example, when operating at low rates of rotation, it may be advisable to insert into the tool sleeve of flexible material a stabilizing bushing for stabilizing the tool sleeve. Such a stabilizing bushing may simultaneously serve as an abutment for the tool elements, so that the tool elements are not pressed into the interior of the sleeve due to the loads acting on the sleeve. This is advisable because the tool sleeve preferably is of flexible material. The sleeve may be, for example, a brush sleeve with radially projecting bristles, for example, U-shaped bristles, wherein the tool sleeve is free of bristles in the area of the axial webs extending over the sleeve.

The various features of novelty which characterize the invention are pointed out with particularity in the claims annexed to and forming a part of this disclosure. For a better understanding of the invention, its operating advantages attained by its use, reference should be had to the drawings and descriptive matter in which there is illustrated and described a preferred embodiment of the invention.

DESCRIPTION OF THE PREFERRED EMBODIMENT

Figure 1:
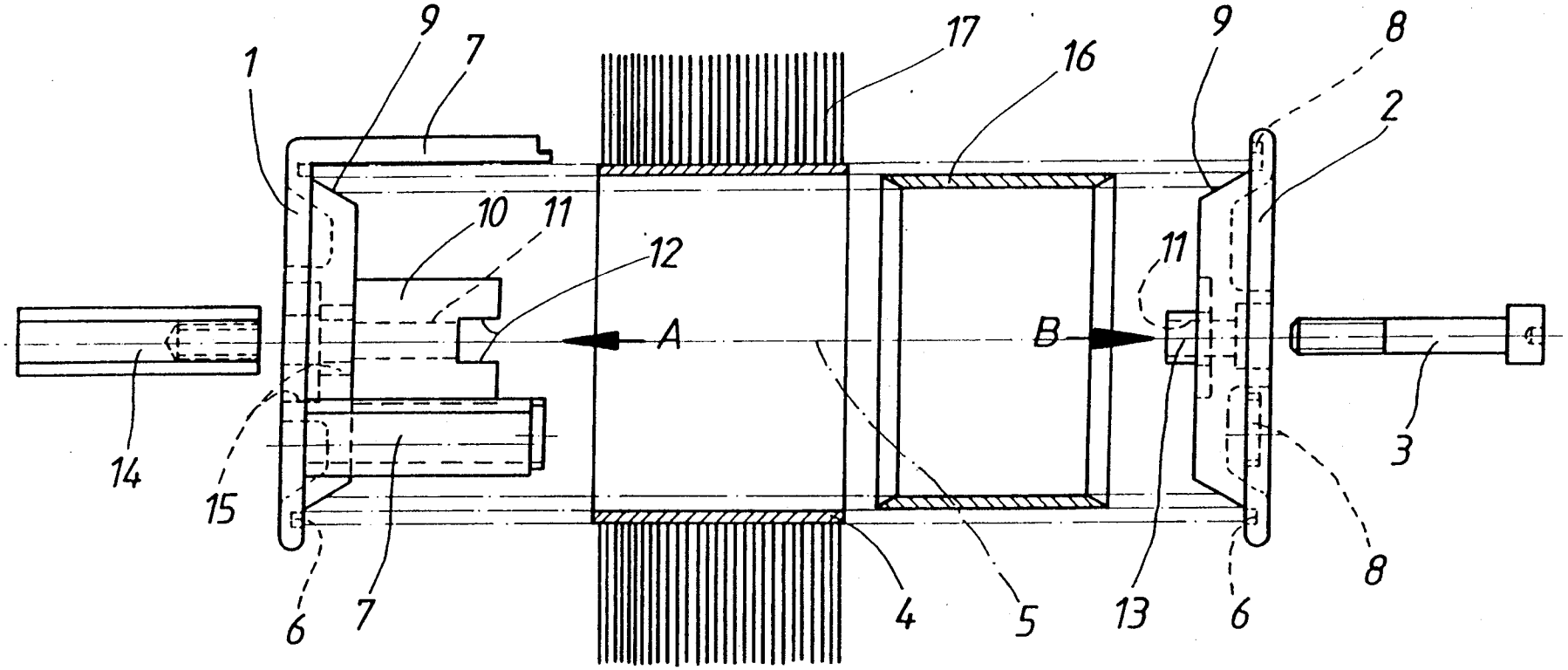
FIG. 1 is an exploded sectional view of a tool chucking device according to the present invention with a tool sleeve and a stabilizing bushing.
Figure 2:
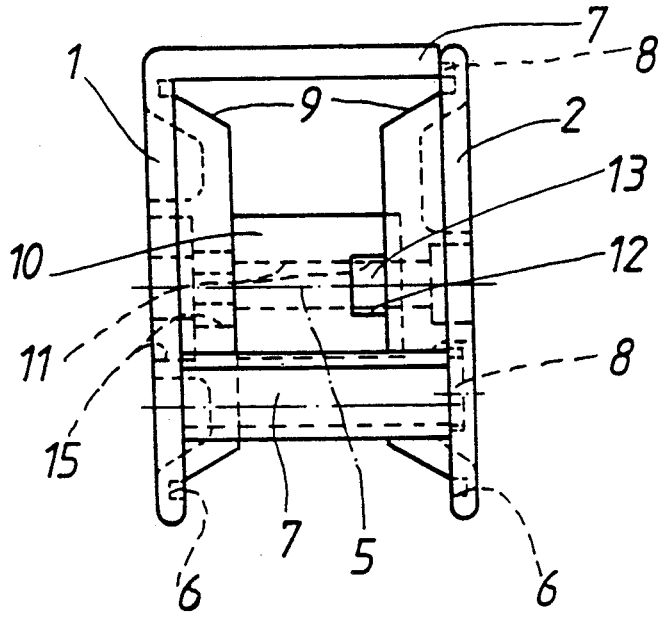
FIG. 2 shows the device of FIG. 1 in the assembled state without tool sleeve and stabilizing bushing.
Figure 3:
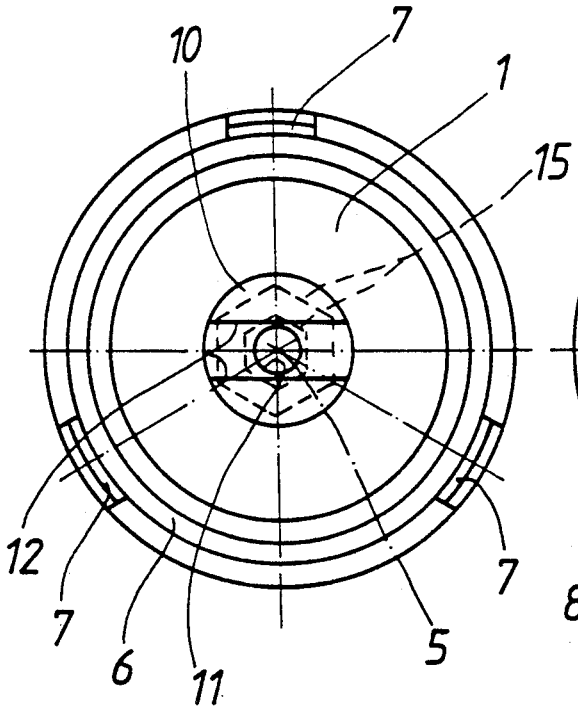
FIG. 3 is a view of the device of FIG. 1 seen in the direction of arrow A of FIG. 1.
Figure 4:
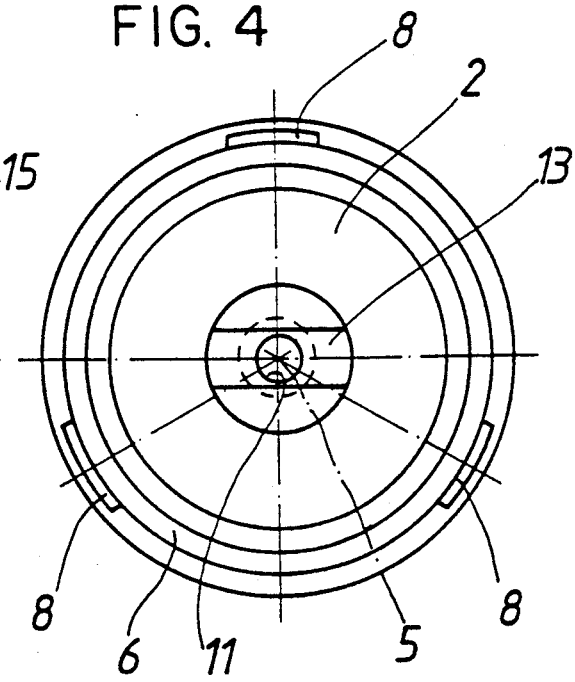
FIG. 4 is a view of the device of FIG. 1 seen in the direction of arrow B of FIG. 1.
Figure 5:
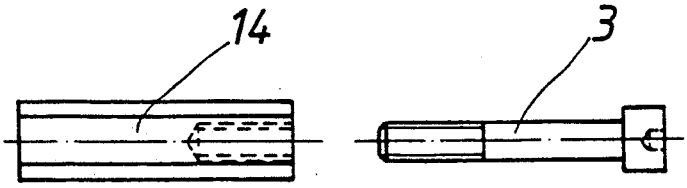
FIG. 5 is a view of a clamping screw and a tightening nut constructed as an adapter for the device of FIG. 1.
Figure 6:
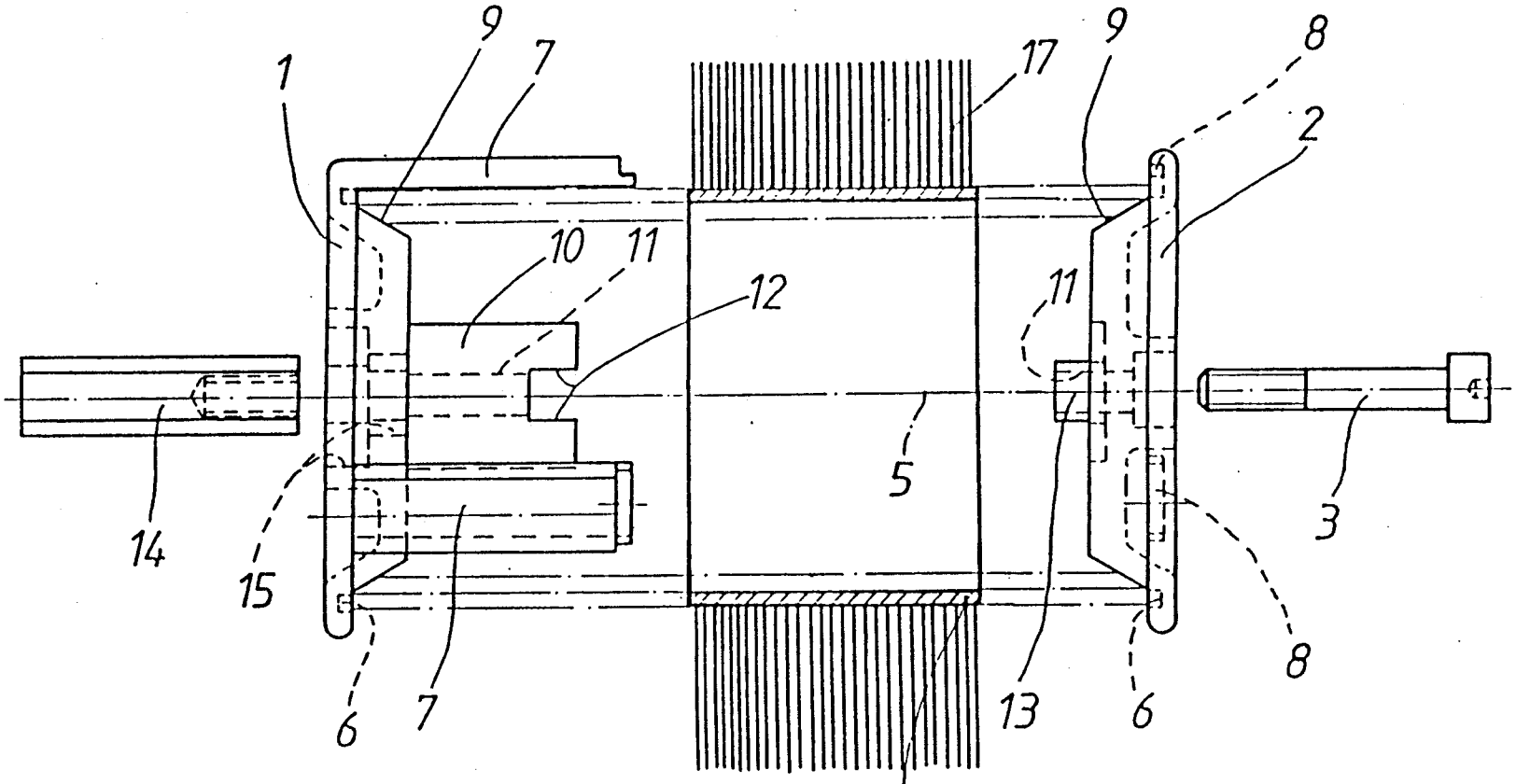
FIG. 6 is a sectional view of a tool chucking device according to the present invention without a stabilizing bushing.

The figures of the drawing show a rotatively driveable tool chucking device with at least two chucking disks 1, 2 and a common tightening screw 3 for chucking a tool sleeve 4 between the two chucking disks 1, 2, wherein the axis of rotation 5 extends through the chucking disks and the tightening screw 3.

The two chucking disks 1, 2 have concentric annular grooves 6 for chucking tool sleeves 4 which have essentially the same diameter, i.e., each chucking disk 1, 2 has at least one such annular groove 6. The chucking disk 1 has axial webs 7 which extend on the outside of the chucked tool sleeve and the other chucking disk 2 has recesses 8 for receiving the ends of the axial webs 7. The axial webs 7 and the recesses 8 are circumferentially spaced in a corresponding manner, for example, at 120°. The axial webs 7 extend at the outer circumference of the corresponding annular groove 6. A centering cone 9 extends adjacent the inner circumference of the annular grooves.

When the tool sleeve 4 is chucked between the two chucking disks 1, 2, the disks are spaced from each other by means of a central shaft 10 which has a longitudinal bore 11. The tightening sleeve 3 can be inserted through the longitudinal bore 11. The chucking disk 1 includes the central shaft 10 which has at the end thereof a polygonal insertion recess 12 and the other chucking disk 2 includes a corresponding polygonal insertion bolt 13.

The tightening screw 3 has a tightening nut constructed as an adapter 14. The adapter 14 can be inserted, on the one hand, into an outwardly directed insertion recess 15 of the corresponding chucking disk 1 such that the adapter 14 is non-rotatable within the recess 15. On the other hand, the adapter 14 is equipped for connecting to a rotary drive, for example, of a drilling machine. The insertion recess 15 is equipped for receiving adapters 14 of different sizes or cross-sections.

A stabilizing bushing 16 having essentially the same width can be inserted in the tool sleeve 4. Preferably a tool sleeve 4 of flexible material is used. In the illustrated example, the tool sleeve 4 is a brush sleeve with radially bristles 17, for example, U-shaped bristles, wherein the tool sleeve 4 is free of bristles in the region of the axial webs 7 extending over the sleeve 4.

While a specific embodiment of the invention has been shown and described in detail to illustrate the application of the inventive principles, it will be understood that the invention may be embodied otherwise without departing from such principles.

We claim:

1. A rotatively driveable tool chucking device comprising at least two chucking disks and a tightening screw extending between the chucking disks, a tool sleeve being chucked between the two chucking disks, the two chucking disks defining concentric annular grooves, the tool sleeve being received without inserting a rubber core in the tool sleeve by the annular grooves, the tool sleeve and the annular grooves having essentially the same diameter and the tool sleeve being of a flexible material, wherein one of the chucking disks has connected thereto axial webs which extend over the tool sleeve and the other chucking disks has recesses for insertion of the ends of the axial webs.

2. The tool chucking device according to claim 1, wherein the axial webs and the recesses are circumferentially equally spaced by 120°.

3. The tool chucking device according to claim 1, wherein the axial webs extend along the outer circumference of the corresponding annular grooves.

4. The tool chucking device according to claim 1, wherein a centering cone is arranged adjacent the inner circumference of the annular groove.

5. The tool chucking device according to claim 1, comprising a central shaft for spacing the two chucking disks apart when the tool sleeve is chucked, the central shaft having a central bore for passing the tightening screw therethrough, the central shaft being attached to one of the chucking disks and having a polygonal receiving recess facing the other chucking disk, and the other chucking disk has a corresponding insertion bolt.

6. A rotatively driveable tool chucking device comprising at least two chucking disks and a tightening screw extending between the chucking disks, a tool sleeve being chucked between the two chucking disks, the two chucking disks defining concentric annular grooves, the tool sleeve being received without inserting a rubber core in the tool sleeve by the annular grooves, the tool sleeve and the annular grooves having essentially the same diameter and the tool sleeve being of a flexible material, wherein one of the chucking disks has connected thereto axial webs which extend over the tool sleeve and the other chucking disk has recesses for insertion of the ends of the axial webs, wherein the tightening screw includes a tightening nut, the tightening nut forming an adapter, one of the chucking disks having an outwardly facing receiving recess, one end of the adapter being non-rotatably insertable in the outwardly facing receiving recess, the other end of the adapter including means for connection to a rotary drive.

* * * * *